US006267302B1

(12) United States Patent
Huffman

(10) Patent No.: US 6,267,302 B1
(45) Date of Patent: Jul. 31, 2001

(54) SPRAY GUN WITH ROLLING WALL DIAPHRAGM AND QUICK DISCONNECT HOUSING

(76) Inventor: David Clark Huffman, 60 Amherst Rd., Merrimack, NH (US) 03054

( * ) Notice: Subject to any disclaimer, the term of this patent is extended or adjusted under 35 U.S.C. 154(b) by 0 days.

(21) Appl. No.: 09/573,614

(22) Filed: May 17, 2000

Related U.S. Application Data

(60) Provisional application No. 60/178,099, filed on Jan. 26, 2000, provisional application No. 60/136,166, filed on May 27, 1999, and provisional application No. 60/134,449, filed on May 17, 1999.

(51) Int. Cl.[7] ..... B05B 1/28

(52) U.S. Cl. ..... 239/291; 239/296; 239/600; 239/DIG. 14; 92/96; 92/98 D; 277/634

(58) Field of Search ..... 239/290, 291, 239/296, 600, DIG. 14; 92/96, 98 D, 105; 277/634, 504

(56) References Cited

U.S. PATENT DOCUMENTS

| | | | | |
|---|---|---|---|---|
| 3,680,789 | | 8/1972 | Wagner . | |
| 3,969,991 | * | 7/1976 | Comstock et al. | 92/98 D |
| 4,208,060 | * | 6/1980 | St. Laurent, Jr. | 277/212 FB |
| 4,768,932 | | 9/1988 | Geberth, Jr. . | |
| 5,613,637 | * | 3/1997 | Schmon | 239/296 |
| 5,695,120 | | 12/1997 | Kingsford . | |
| 5,707,010 | * | 1/1998 | Manfre et al. | 239/296 |
| 5,720,437 | * | 2/1998 | Wu | 239/296 |
| 5,799,875 | * | 9/1998 | Weinstein et al. | 239/296 |
| 5,863,184 | | 1/1999 | Juterbock et al. . | |

FOREIGN PATENT DOCUMENTS

WO 98/02659 1/1998 (WO) .

* cited by examiner

*Primary Examiner*—David A. Scherbel
*Assistant Examiner*—Steven J. Ganey
(74) *Attorney, Agent, or Firm*—Vernon C. Moine; Scott J. Asmus

(57) ABSTRACT

A spray gun configured with a roiling wall diaphragm piston and vented piston cylinder connecting the needle to the needle actuator and isolating the liquid chamber of the nozzle body from the actuator section. The flange of the rolling wall diaphragm is sealed between the mating faces of the nozzle body housing and the actuator housing. The actuator is a double action air operated piston and cylinder. Sanitary, non-threaded quick disconnect couplings are used between the several components of the spray gun for easy cleaning and servicing of the nozzle body, tip and needle, and easy replacement of the rolling wall diaphragm.

16 Claims, 4 Drawing Sheets

SPRAY GUN WITH ROLLING WALL DIAPHRAGM AND QUICK DISCONNECT HOUSING

This application claims priority to provisional application numbers 60/134,449, 60/136,166 and 60/178,099 filed on May 17, 1999, May 27, 1999 and Jan. 26, 2000, respectively.

BACKGROUND OF THE INVENTION

1. Technical Field of the Invention

This invention most generally relates to spray guns, both air atomizing and hydraulic pressure atomizing; and in particular, it relates to the shut-off/clean out needle mechanism of a spray gun and the use of a rolling wall diaphragm seal to isolate the shut-off valve needle from the needle actuator, and to quick disconnect components for servicing the front end and liquid chamber elements of the spray gun.

2. Background Art

Prior art FIG. 1 details the mechanics of a conventional, air-atomized spray gun system, through which a source of liquid to be sprayed, and a source of compressed air, are emitted from a special nozzle in converging streams so as to cause the stream of liquid to be atomized by the air flow and projected in a precise pattern; permitting the controlled spray deposition of the liquid material onto a target surface.

The spray air and fluid are directed under pressure in converging streams so as to generate the atomized spray pattern. After use, a suitable solvent is typically run through the system for cleaning, further challenging the integrity of the seals. Common practice includes frequent partial disassembly, for cleaning and closer inspection of individual components.

Conventional atomizing spray gun designs include a liquid chamber and a tip section with an axial fluid outflow orifice and shut off needle, where the needle has a tapered or conical section that contacts the back of the fluid tip to close off the flow of the liquid being sprayed. The shut off needle can also have an extended tip end clean out section of uniform diameter, where the clean out portion of the needle protrudes through the fluid tip orifice when the needle is in the closed or sealed position.

The needle travels back and forth between the fully closed position, preventing flow of the liquid being sprayed, and the retracted or open position, allowing the liquid to flow out the nozzle. A biasing force in the shut off direction, sufficient to hold the needle forward, closed and sealed at all operating pressures, is provided by a spring on the aft end of the needle shaft. The actuating force to open the orifice and start the flow of liquid is provided by a piston attached to the needle shaft. The piston is located at the aft end of an air cylinder through which the needle shaft passes. When air is applied to the cylinder, the piston compresses the spring and pulls the needle away from the nozzle to permit liquid flow.

Between the liquid chamber and the air cylinder is an interference seal through which the needle shaft slides. This seal prevents the liquid from the liquid chamber from leaking along the needle shaft into the air cylinder. The interference seal is commonly an "O" ring, quad seal or a packing bushing that is intended to be resistant to the materials being sprayed, and the solvents commonly used for clean up. This simple and economical sealing method may be satisfactory for many spraying applications, but for liquids with a high adhesion rate or liquids with a high abrasion rate, these seals are likely to fail in a relatively shorter period of time. This is due to the fact that the seal cannot adequately wipe the needle clean as it cycles, allowing some of the liquid to pass into and by the seal and thereby cause premature failure of the seal.

Referring to prior art FIG. 1, the illustrated prior art spray gun 100 includes a nozzle section consisting of a fluid tip 101 and air cap 102 secured by collar 103 to body 104. Spray liquid port 105 connects a liquid source to the liquid chamber and hence to fluid tip 101. Spray air port 106 connects through internal passageways to air cap 102. Axial metering and shut off needle 107 is operated between open and closed positions by single acting air cylinder and piston assembly 108, and shut off biasing spring 109. Needle opening port 110 connects to cylinder and piston assembly 108. Needle shaft seals 111 and 112, divided by vent 113, isolate the liquid from the front end of spray gun 100 from the air cylinder and piston assembly 108.

A close inspection of this and other prior art designs for atomizing spray guns discloses a further problem relating to how to best service the spray gun after use. The typical time required for break down, cleaning and/or maintenance, and re-assembly, is often a disincentive to good maintenance practices.

Other types of seals have been used in related devices and specialty spray guns to isolate the metering valve stopper and liquid chamber from the valve actuating mechanism. Kingsford's U.S. Pat. No. 5,695,120, is an airless spray gun for de-ionized water that provides continuous circulation of liquid from the liquid source through the gun between "on" periods of spraying. It has a valve stopper member that incorporates a diaphragm disk element for sealing the back wall of the liquid chamber from the trigger mechanism.

There are other classes of paint spraying devices. For example, airless paint sprayers utilizing direct pumping of paint with piston or diaphragm pumps are well known in the art. Such patents as Geberth's U.S. Pat. No. 4,768,932, a hydraulic paint pump; Wagner's U.S. Pat. No. 3,680,789, a spray gun with an electric vibrator and a diaphragm pump; and Juterbock's U.S. Pat. No. 5,863,184, a diaphragm pump for spraying high viscosity liquids, will provide context for some related materials.

Rolling wall diaphragms are commonly known to be used as seals in other types of piston and cylinder applications. Furon Company's WO98/02659 patent application for a double acting pneumatically driven rolling wall diaphragm pump is illustrative of this sealing technique.

In summary, there is clearly room for improvement in the art of atomizing spray guns, particularly as to the sealing of the needle shaft, and also in the provisions for disassembly and maintenance of the spray gun.

SUMMARY OF THE INVENTION

The invention, most simply stated, is a spray gun with novel shut off mechanism utilizing a rolling wall diaphragm seal to isolate the liquid chamber and shut-off needle from the needle actuator mechanism, and a quick disconnect housing coupling for opening the gun for cleaning and servicing. The diaphragm and diaphragm piston connect the needle valve to the needle valve operating piston while isolating the operating piston from the liquid as it is pumped through the liquid chamber and ejected from the nozzle as an atomized spray. The quick disconnect coupling provides for opening the gun for servicing and cleaning the liquid chamber, needle and diaphragm. In its sanitary coupling embodiment, it elates all pipe threads and threaded components from the nozzle body end of the gun.

It is an object of the invention to eliminate the internal sliding seals from the needle shaft in the liquid chamber of an atomizing spray gun. To this end, a rolling wall diaphragm and diaphragm piston have been introduced to replace the sliding seals of the prior art for sealing the needle operating piston from contact with the liquid being sprayed and the solvents used for cleaning.

It is a flier object to provide means for easy servicing and cleaning of the liquid chamber, needle and diaphragm face. To this end, the gun has front and rear housings which are assembled by a quick disconnect means such as an external quick disconnect nut or clamp.

It is yet a further object to provide an alternative to a fixed needle shut off spring which must over come the additional pressure exerted on a diaphragm and diaphragm piston. To this end, a double action needle valve operating piston is provided, with control air for both needle opening and needle closing functions.

Still other objects and advantages of the present invention will become readily apparent to those skilled in this art from the following detailed description, wherein I have shown and described only a preferred embodiment of the invention, simply by way of illustration of the best mode contemplated by me on carrying out my invention.

DESCRIPTION OF THE PREFERRED EMBODIMENT

An enabling disclosure of the preferred embodiment is provided in the figures and the following description, from which those skilled in the art will readily deduce other variations within the scope of the invention.

Figure 2:
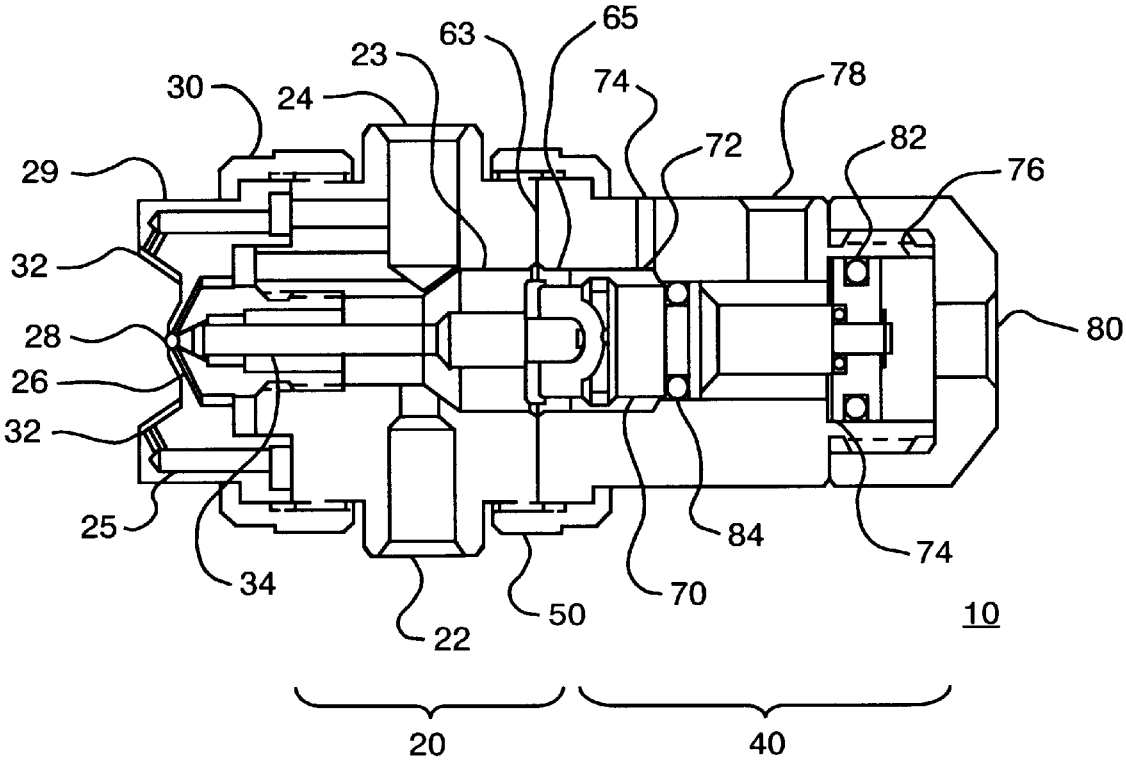
FIG. 2 is a cross section schematic of the preferred embodiment of the invention, disclosing the placement and function of the rolling wall diaphragm seal in the shut-off clean out mechanism, and the quick disconnect fastening nut attaching the actuator housing to the nozzle body.
Figure 3:
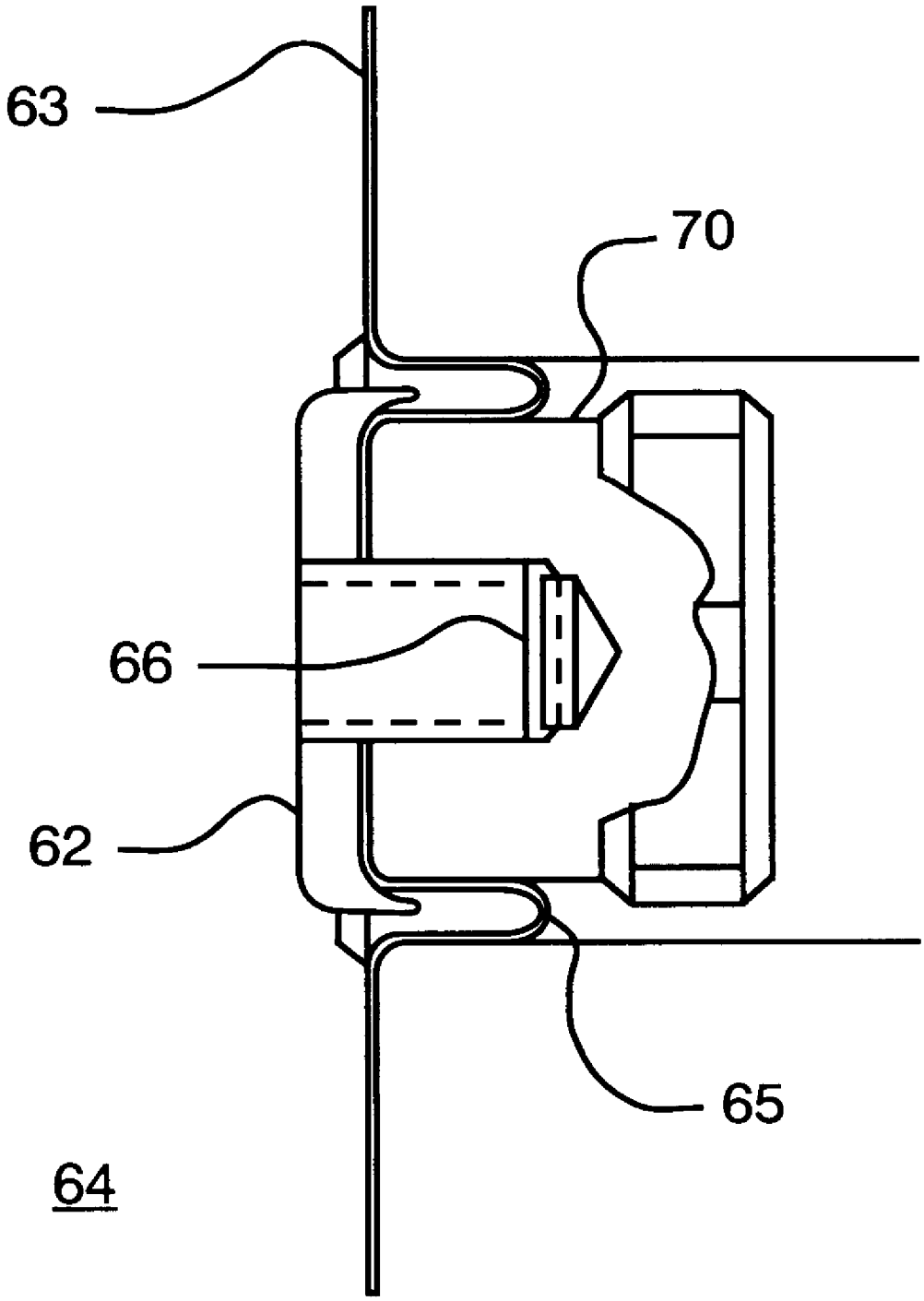
FIG. 3 is a partial cross section schematic of the needle piston and rolling wall diaphragm of the embodiment. of FIG. 2.

Referring to FIGS. 2 and 3, a preferred embodiment of the invention is illustrated as spray gun 10. Spray gun 10 consists of two principle components; a nozzle body 20 and actuator 40, coupled by quick disconnect fastening nut 50. The use of quick disconnect nut at this juncture, in combination with other aspects of the invention, has significance with regard to easy assembly and maintenance.

Consistent in this respect with the prior art, fluid tip 26, with center spray liquid orifice 28, and air cap 29, with periphery spray air orifices 32, are secured by quick disconnect fastening nut 30 to housing 20. Spray liquid port 22 communicates through the central liquid chamber 23 with fluid tip 26 and center orifice 28, providing a flow path for the spray liquid. Spray air port 24 communicates through internal passageways 25 to periphery orifices 32, providing a flow path for spray air.

Orifices 32 are oriented so as to direct spray air flow to converge on and atomize the spray liquid outflow from orifice 28, forming the desired spray pattern. Valve needle 34 is axially oriented within housing 20 for push/pull movement for controlling the flow of spray liquid. One end of needle 34 has a tapered shoulder to seat for shut off against the inner face of orifice 28 of fluid tip 26, and an extended clean out tip that extends into orifice 28.

Referring to FIGS. 2 and 3, and departing here from the prior art, the other end or stem of needle 34 has a necked down, threaded end, which at assembly is passed through washer 62, through the center of rolling wall diaphragm 64, and screwed into threaded axial bore 66 of diaphragm piston 70, in cylinder 72, thereby sealing the center flange of the rolling wall diaphragm between the washer and the diaphragm piston.

The perimeter flange 63, of diaphragm 64, is compressed securely between the mating faces of housings 20 and 40 by fastening nut 50. Cylinder 72 is vented at its aft or actuator end by cylinder vent port 74. Rolling wall section 65, of diaphragm 64, is dispersed between piston 70 and cylinder 72, biased away from liquid chamber 23 to function as a rolling wall seal under the positive pressure gradient of the liquid chamber to the vented diaphragm cylinder chamber, rolling with the movement of piston 70.

Diaphragm piston 70 is attached by a shaft to a double action operating piston 74, in cylinder 76. Air pressure applied to open air port 78 forces operating piston 74 to its aft limit, thereby retracting needle 34 for spraying. Conversely, air pressure applied to closing air port 80, forces operating piston 74 to its forward limit, thereby advancing needle 34 to reduce or stop spraying. O ring seal 82 isolates the closing side chamber of cylinder 76 from the opening side chamber. O ring seal 84 isolates the opening side chamber of cylinder 76 from the vented chamber of diaphragm piston cylinder 72.

The geometry of the diaphragm 64 and its mounting are arranged, and the stroke of the diaphragm piston limited, so as to operate only in the mid range of the diaphragm stroke limits, for maximum diaphragm life. It will be evident that upon uncoupling of housings 20 and 40, needle 34 and other components are readily accessible for cleaning, and diaphragm 64 is readily removable for periodic replacement before an actual failure is likely to occur.

Alternatively, washer 62 may have a threaded nipple and be screwed into piston 70 directly, the stem of needle 34 screwing then into the washer, so as to enable removal of the needle from the diaphragm piston assembly without disturbing the diaphragm's center seal to the piston. This configuration, combined with any means for retaining the diaphragm flange seal, such as the use of a suitable adhesive on the actuator side of the flange at installation, permits the actuator section to remain completely sealed when the nozzle body section is uncoupled and disassembled for cleaning.

From within liquid chamber 23, looking aft, it will be apparent that the full diameter of the diaphragm piston 70 and rolling wall diaphragm 64 are subjected to the operating pressure within the chamber. The spray flow rate of spray gun 10 varies directly with the pressure in liquid chamber 23. As the pressure increases inside liquid chamber 23, the aft force on the diaphragm piston increases, tending to force valve needle 34 to the aft or open position. This effect is much greater with this design than with needle mechanisms of the prior art using relatively small diameter needles and interference seals. This makes using a spring for the needle closing bias pressure difficult, due to the higher spring force needed to overcome the rearward force on the diaphragm piston.

Figure 1:
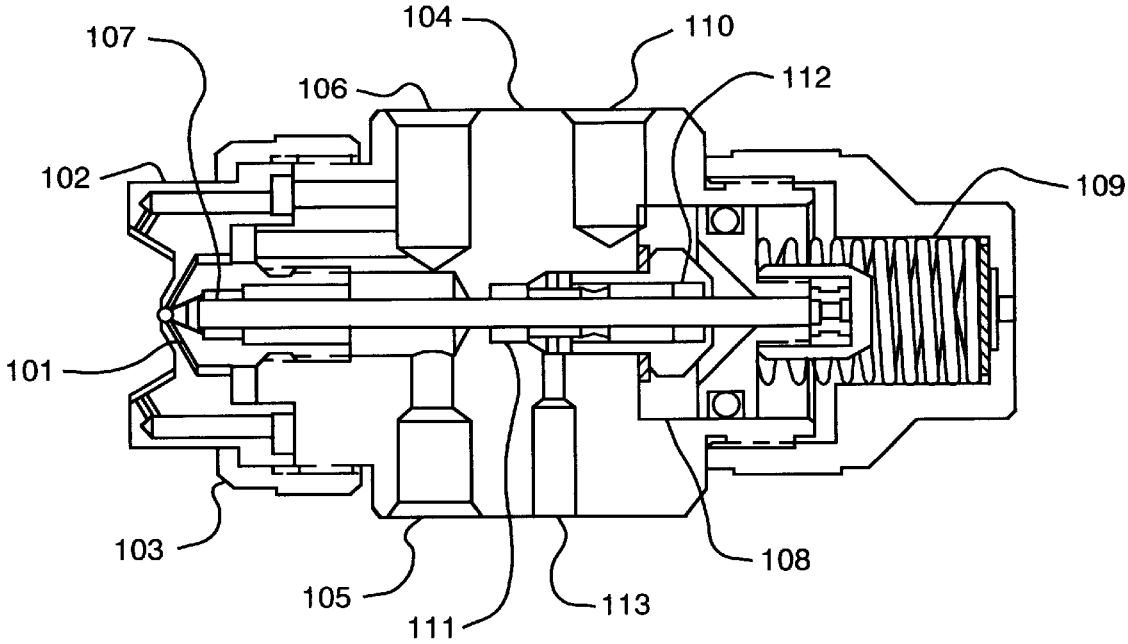
FIG. 1 (PRIOR ART)
FIG. 1 is a cross section schematic of a spray gun of the prior art, disclosing the needle and interference seals and other components common to the design.

While the double action operating piston shown here is a preferred embodiment, it is never-the-less within the scope of the invention to use a bias spring for closing, and a single action air operated opening piston, for operating the needle, analogous to the actuator of prior art FIG. 1.

As is known to those skilled in the art, the minimum time to fully cycle a piston with a rolling wall diaphragm, without exceeding the limitations of the diaphragm, is inherently greater than with other forms of seals; typically in the order of 1 second per cycle. Not withstanding the cycle time, there is still the need to be able to exert an on or off signal from a remote control center with little or no lag time before the actuator is activated. While compressed air is a convenient medium for operating the actuator in some settings, long control lines from a remoted control center may contain enough of this compressible medium to cause a significant lag in actuator response. For this reason, electric solenoids provide a useful alternative to air operated piston actuators in a spray gun, and are especially suited to use with electronic control systems.

Figure 4:
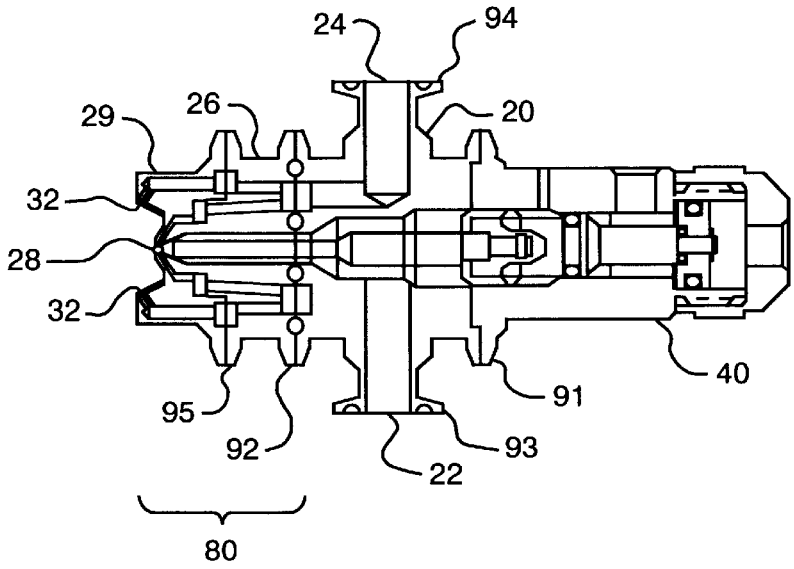
FIG. 4 is a cross-section view of a preferred embodiment of the invention, sanitary connection couplings between all body components and sanitary connection nipples for air and fluid inlets.
Figure 5:
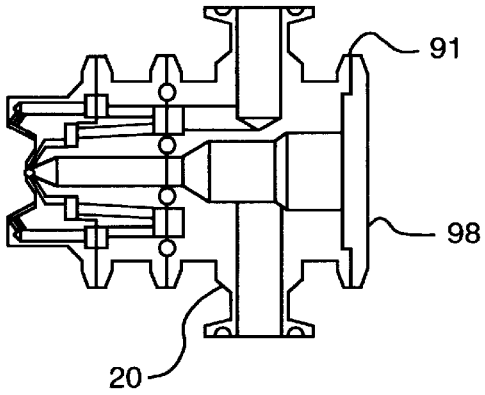
FIG. 5 is a cross-section view of a preferred embodiment of the invention, an automatic spray gun configured with a block off cap rather than an actuator, the cap being mated to the nozzle body with a sanitary connection coupling.
Figure 6:
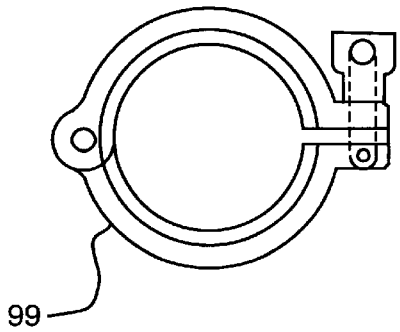
FIG. 6 is a face view of a V clamp for a sanitary connection coupling, for holding the joint in axial alignment and sealed together against internal pressure.

Referring to FIGS. 4, 5 and 6, analogous to the embodiment of FIG. 1, there is a nozzle body 20 and actuator 40, the mating faces of which are configured with clamping flanges 91. These external flanges are configured specifically for being coupled with a suitably sized sanitary V clamp 99, as are flanges 93 and 94 of ports 22 and 24. Additionally, nozzle 80 consists of air cap 29 and fluid tip 26, here coupled together with external coupling flanges 95 and a suitably sized V clamp 99, and hence coupled to nozzle body 20 with external coupling flanges 92 and a suitably sized V clamp 99. The external clamping flanges and V clamps have replaced all threaded fasteners on the nozzle body, and on the coupling between the nozzle body and the actuator housing.

Referring to FIG. 5, for continuous spraying applications, or where remote control of spray liquid flow and spray air flow is sufficient for the purpose, nozzle body 20, may be configured without a shut off needle for continuous spraying, with a cap 98, suitably clamped at clamping flange 91, in place of an actuator.

As will be realized, the invention is capable of other and different embodiments, and its several details are capable of modifications in various obvious respects, all without departing from the invention. As examples, the means for quick disconnect of the front and rear housings may be independent of or supplemental to the means for sealing the perimeter flange of the diaphragm. The quick disconnect means may be other than abutting flanges and a clamp, or a threaded shoulder and retaining flange joined with a fastening nut, such as internal or external locking bayonet lugs and receiver structure or alignment pins and holes on the mating faces and periphery latches.

Furthermore, the diaphragm retaining washer may be independently attachable through the diaphragm to the diaphragm piston, and the needle valve stem attachable to the diaphragm retaining washer. The operating piston may be electrically actuated by solenoids, or by indirectly by levers or cams. Utilizing a combination of these variations, there may be provided an embodiment providing for the front housing and the needle valve to be removable without breaking the diaphragm seat and seal, all of which is within the scope of the invention.

Additional examples of the invention include a spray gun for application of liquids in an atomized spray pattern, consisting of a nozzle body housing with a mating face, a liquid chamber opening to the mating face, a spray liquid supply port connecting to the liquid chamber, an atomizing spray nozzle with a fluid tip connecting to the liquid chamber, and a needle. The needle is moveable forward for closing off the fluid tip to outflow of spray liquid and moveable aft for opening the fluid tip to outflow of spray liquid.

There is included an actuator housing with a mating face, a vented diaphragm cylinder with one end opening on the mating face, a rolling wall diaphragm with a center section and a perimeter flange, a diaphragm piston installed in the diaphragm cylinder and attached to a diaphragm piston actuator, where the center section of the diaphragm can be secured to the diaphragm piston, and the perimeter flange extends out around the cylinder opening over the mating face. The stem or aft end of the needle can be attached to the diaphragm piston, and there is a quick disconnect coupling for connecting the nozzle body housing to the actuator housing at their respective mating faces.

The nozzle body may have a spray air port, with spray air orifices connected by interior passageways to the spray air port. The actuator may include a double action air operated piston and cylinder assembly with an opening air port and a closing air port, or it may have a single action air operated opening piston and cylinder, and an opposing action closing spring, or a double action electric solenoid with an opening circuit and a closing circuit, or even a single action electric solenoid with an opening circuit, and an opposing action closing spring.

Further examples of the invention include spray guns for application of liquids in an atomized spray pattern, that have a nozzle body housing having a nozzle end mating face and an actuator end mating face, a liquid chamber opening to both mating faces, a spray liquid port connecting to the liquid chamber, a spray air port connecting to interior passageways, and a needle. They may also have an atomizing spray nozzle with a fluid tip and an air cap, where the fluid tip has a nozzle body mating face and a spray liquid outflow orifice and an air cap with multiple spray air outflow orifices. They may have non-threaded, quick disconnect type couplings for connecting the spray nozzle to the nozzle body housing so as to connect the interior passageways to the spray air outflow orifices, and the liquid chamber to the spray liquid outflow orifice; and to orient the shut off needle for controlling flow of spray liquid through the fluid tip.

These examples may also include an actuator housing with a nozzle body mating face, a vented diaphragm cylinder with a cylinder end opening on the mating face, and a rolling wall diaphragm with a center section and a perimeter flange, where the center section is attached to a diaphragm piston, the diaphragm piston is installed in the diaphragm cylinder and is attached to a diaphragm piston actuator, and the perimeter flange of the diaphragm extends around the cylinder opening and out over the mating face. There may be sanitary, non-threaded, quick disconnect couplings between the nozzle body housing and the actuator housing, such as each mating face having a coupling flange extending outward and V clamps securable over abutting coupling flanges. The spray liquid port and spray air port may be similarly configured with sanitary, non-threaded quick disconnect couplings for connecting to respective liquid and air sources.

The benefits of the invention may extend to manual, automatic, robotic and other variations of spray guns which depend on a needle valve shut off mechanism, require isolation of the operating piston from the spray liquid or cleaning solvents, and benefit from having a quick disconnect housing break down feature for easy internal access and a greater degree of sanitation.

The following claims are illustrative but not exhaustive of the scope of the invention.

What is claim is:

1. A spray gun for application of liquids in an atomized spray pattern, comprising:

a nozzle body housing having a mating face, a liquid chamber opening to said mating face, a spray liquid supply port connecting to said liquid chamber, an atomizing spray nozzle with a fluid tip connecting to said liquid chamber, and a needle, said needle being moveable forward for closing said fluid tip to outflow of said spray liquid and moveable aft for opening said fluid tip to said outflow of said spray liquid, an actuator housing with a mating face, a vented diaphragm cylinder with one end opening on said mating face, a rolling wall diaphragm with a center section and a perimeter flange, a diaphragm piston installed in said diaphragm cylinder and attached to a diaphragm piston actuator, said center section of said diaphragm securable to said diaphragm piston, said perimeter flange extending over said mating face, a means for attaching said needle to said diaphragm piston, and a quick disconnect means for coupling said nozzle body housing to said actuator housing at respective said mating faces.

2. A spray gun for application of liquids in an atomized spray pattern according to claim 1, said nozzle body comprising a spray air port, said nozzle comprising spray air orifices connected by interior passageways to said spray air port.

3. A spray gun for application of liquids in an atomized spray pattern according to claim 1, said diaphragm piston actuator comprising a double action air operated piston and cylinder assembly with an opening air port and a closing air port.

4. A spray gun for application of liquids in an atomized spray pattern according to claim 1, said diaphragm piston actuator comprising a single action air operated opening piston and cylinder, and an opposing action closing spring.

5. A spray gun for application of liquids in an atomized spray pattern according to claim 1, said diaphragm piston actuator comprising a double action electric solenoid with an opening circuit and a closing circuit.

6. A spray gun for application of liquids in an atomized spray pattern according to claim 1, said diaphragm piston actuator comprising a single action electric solenoid with an opening circuit, and an opposing action closing spring.

7. A spray gun for application of liquids in an atomized spray pattern according to claim 1, said means for attaching said needle to said diaphragm piston comprising a threaded stem on said needle rotably engageable into a threaded centerbore in the face of said diaphragm piston.

8. A spray gun for application of liquids in an atomized spray pattern according to claim 1, said quick disconnect means comprising a threaded shoulder section around said mating face on a first of said housings, a retaining flange around said mating face on the second of said housings, and a quick disconnect fastening nut.

9. A spray gun for application of liquids in an atomized spray pattern according to claim 1, said quick disconnect means comprising a mating face coupling flange extending outward from said mating faces on each of said housings and a V clamp securable over said coupling flanges.

10. A spray gun for application of liquids in an atomized spray pattern, comprising:

a nozzle body housing with a mating face, a liquid chamber opening to said mating face, a spray liquid supply port connecting to said liquid chamber, a spray air port, an atomizing spray nozzle with a fluid tip connecting to said liquid chamber and with spray air orifices connecting with said spray air port, and a needle, said needle being moveable forward for closing said fluid tip to outflow of said spray liquid and moveable aft for opening said fluid tip to said outflow of said spray liquid, an actuator housing with a mating face, a vented diaphragm cylinder with one end opening on said mating face, and a rolling wall diaphragm with a center section and a perimeter flange, said center section attached to a diaphragm piston, said diaphragm piston installed in said diaphragm cylinder and attached to a diaphragm piston actuator, said diaphragm piston actuator comprising a double action air operated piston and cylinder assembly with an opening air port and a closing air port, said perimeter flange of said diaphragm extending over said mating face, said needle having a threaded stem rotably engageable in a threaded centerbore in the face of said diaphragm piston, and a quick disconnect means for coupling said front housing to said rear housing.

11. A spray gun for application of liquids in an atomized spray pattern according to claim 10, said quick disconnect means comprising a threaded shoulder section around said mating face on a first of said housings, a retaining flange around said mating face on the second of said housings, and a quick disconnect fastening nut.

12. A spray gun for application of liquids in an atomized spray pattern according to claim 10, said quick disconnect means comprising a mating face coupling flange extending outward from said mating faces on each of said housings and a V clamp securable over said coupling flanges.

13. A spray gun for application of liquids in an atomized spray pattern, comprising:

a nozzle body housing having a nozzle end mating face and an actuator end mating face, a liquid chamber opening to both said mating faces, a spray liquid port connecting to said liquid chamber, a spray air port connecting to interior passageways, and a needle, an atomizing spray nozzle having a fluid tip and an air cap, said fluid tip having a nozzle body mating face and a spray liquid outflow orifice and an air cap with multiple spray air outflow orifices, a non-threaded quick disconnect means for coupling said spray nozzle to said nozzle body housing so as to connect said interior passageways to said spray air outflow orifices and to connect said liquid chamber to said spray liquid outflow orifice and to orient said needle for controlling flow through said fluid tip, an actuator housing having a nozzle body mating face, a vented diaphragm cylinder with a cylinder end opening on said mating face, and a rolling wall diaphragm with a center section and a perimeter flange, said center section attached to a diaphragm piston, said diaphragm piston installed in said diaphragm cylinder and attached to a diaphragm piston actuator, said perimeter flange extending over said mating face, a means for attaching said needle to said diaphragm piston, and a non-threaded quick disconnect means for coupling said nozzle body housing to said actuator housing.

14. A spray gun for application of liquids in an atomized spray pattern according to claim 13, said non-threaded quick disconnect means comprising a mating face coupling flange extending outward from respective said mating faces and V clamps securable over said coupling flanges.

15. A spray gun for application of liquids in an atomized spray pattern according to claim 13, said spray liquid port and said spray air port configured with non-threaded quick disconnect means for connecting to respective liquid and air sources.

16. A spray gun for application of liquids in an atomized spray pattern according to claim 15, said means for connecting to respective liquid and air sources comprising coupling flanges on said spray air port and on said spray liquid port, end coupling flanges on lines connecting to respective said liquid and air sources, and V clamps securable over said coupling flanges.

* * * * *